United States Patent [19]

Fukuroi

[11] 3,945,090

[45] Mar. 23, 1976

[54] AUTOMATICALLY LOCKING SLIDER FOR SLIDE FASTENERS

[75] Inventor: Takeo Fukuroi, Uozu, Japan

[73] Assignee: Yoshida Kogyo Kabushiki Kaisha, Japan

[22] Filed: Oct. 22, 1974

[21] Appl. No.: 516,905

[30] Foreign Application Priority Data

Oct. 29, 1973 Japan ..... 48-125153

[52] U.S. Cl. ..... 24/205.14 R

[51] Int. Cl.[2] ..... A44B 19/30

[58] Field of Search ..... 24/205.14 R, 205.14 K

[56] References Cited

UNITED STATES PATENTS

| | | | |
|---|---|---|---|
| 2,523,740 | 9/1950 | Ulrich | 24/205.14 R |
| 2,569,298 | 9/1951 | Erdmann | 24/205.14 |
| 2,635,314 | 4/1953 | Firing | 24/205.14 |
| 2,810,945 | 10/1957 | Legat | 24/205.14 R |
| 2,913,795 | 11/1959 | Brown | 24/205.14 R |
| 3,045,307 | 7/1962 | Poux | 247/205.14 R |
| 3,070,865 | 1/1963 | Huelster | 24/205.14 R |

FOREIGN PATENTS OR APPLICATIONS

| | | | |
|---|---|---|---|
| 736,364 | 6/1943 | United Kingdom | 24/205.14 R |

*Primary Examiner*—Bernard A. Gelak
*Attorney, Agent, or Firm*—Bucknam and Archer

[57] ABSTRACT

An automatically locking type of slider is disclosed for use with a slide fastener, which slider incorporates locking means to lock the slider into position on the fastener stringers. The locking means consists of a resilient plate member centrally bent into a U-shaped structure with two arm portions, one of which arm portions is provided with a support lug or lugs at one end and a locking prong at the other engageable in locking relation with the fastener stringers. The support lug is engageable in an aperture formed in the slider body in such a manner as to restrict free movement of the locking means during manipulation of the pull tab.

2 Claims, 5 Drawing Figures

AUTOMATICALLY LOCKING SLIDER FOR SLIDE FASTENERS

BACKGROUND OF THE INVENTION

This invention relates to an automatically locking slider for slide fasteners. By the automatically locking slider is meant a slider having means for automatically holding it in locked position on the slide fastener when its pull tab is released from engagement with the fastener elements after the fastener has been closed.

There have hitherto been proposed a number of automatically locking sliders of which construction basically includes a slider body constituted by an upper and a lower shield, a cap-like yoke attached to the slider body, a pull tab movably connected to the yoke and a resilient locking member accommodated in the yoke and operatively associated with the pull tab in such a manner that lifting the pull tab causes the locking member to disengage from a slide fastener stringer and flipping and pull tab flat against the slider body allows the locking member to restore by its own tension and engage with the fastener stringer to lock the slider thereon. With such construction wherein the locking member is disposed for free movement within the yoke in a direction in which the pull tab is manipulated, the locking member is liable to shift out of the correct path of its operative movement relative to the fastener stringer.

SUMMARY OF THE INVENTION

With the above-noted drawback in view, it is an object of this invention to provide an improved automatically locking slider which incorporates structural features such that the locking member cana be maintained in its correct operative path against manipulation of the pull tab in any direction.

Another related object of the invention is to provide an automatically locking slider wherein the pull tab can be manipulated with a greater degree of smoothness.

Briefly stated, those objects can be achieved by the provision according to the invention of a slider having locking means disposed for stopping engagement at one end with an aperture formed in the slider body during manipulation of the pull tab so as to restrict free longitudinal movement of the locking means.

The features which are believed to be novel of the invention will be more apparent from the following detailed description taken in connection with the accompanying drawings which illustrate by way of example a preferred embodiment which the invention may assume in practice and in which like reference numerals denote like parts throughout the several views.

DETAILED DESCRIPTION OF THE PREFERRED EMBODIMENTS

Figure 5:
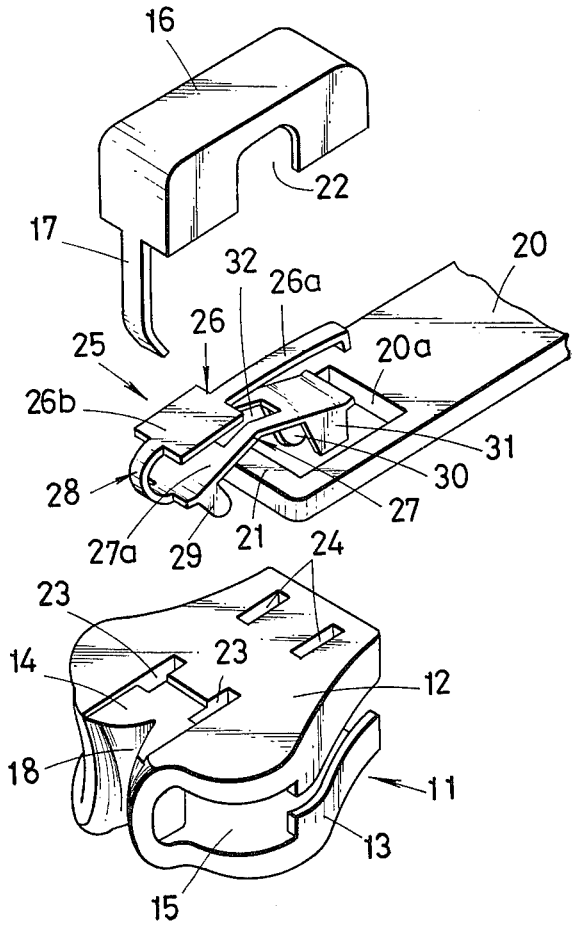
FIG. 5 is an exploded, perspective view of the slider of FIG. 1, better illustrating the construction of the same.

Referring now to the drawings and to FIG. 5 in particular which better illustrates the general construction of an automatically locking slider according to the invention, it will be seen that the slider 10 includes a slider body 11 constituted by a flanged upper shield 12 and a flanged lower shield 13. The upper and lower shields 12 and 13 are joined at one ends by a neck 14 and spaced apart in parallel from each other to form a channel 15 for the passage of a slide fastener (not shown). To the upper shield 12 is attached a cap-like yoke 16 which has at one end a downwardly extending elongated portion 17 adapted to fit into a recess 18 formed in the neck 14 and at the other a horizontally bent portion 19 (FIGS. 1, 2 and 3) anchored to an end of the upper shield 12 opposite to the neck 14.

Designated at 20 is a pull tab pivotally attached to the yoke 16 and having a square aperture 20*a* and a pivotal end 21 adapted to hinge an opening 22 formed in and extending laterally of the yoke 16.

The upper shield 12 of the slider 10 is provided for purposes hereafter explained with a first pair of laterally spaced cavities or preferably apertures 23 at a forward end adjacent the neck 14 and a second pair of similar aperture 24 at the opposite or rearward end, at least one of which apertures 24 communicates with the channel 15 through which the fastener stringers are guidedly moved.

Figure 4:
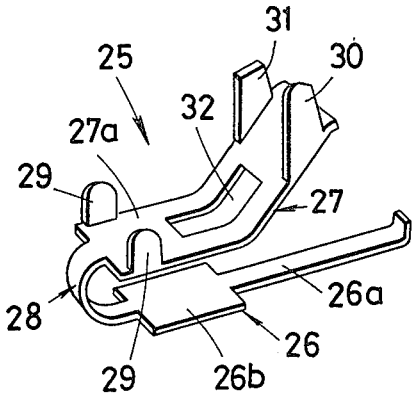
FIG. 4 is a perspective view of a locking means incorporated in the slider of the invention said means being shown upside down.

Illustrated in FIG. 4 in particular is locking means 25 operatively associated with the pull tab 20 for releasably locking the slider 10 into position on the fastener stringers. The locking means 25 is made of a suitable resilient material such as for example a leaf spring or similar plate member which is bent substantially into a U-shaped structure, as shown. The locking means 25 has two arms 26 and 27 interconnected by an arcuate neck 28. The first or upper arm 26 is provided with a reduced-width portion 26*a* and a substantially square portion 26*b* adjoining the arcuate neck 28, both portions being disposed for abutment against the inner wall of the yoke 16. The second or lower arm 27 is slightly downwardly bent centrally thereof relative to the first arm 26. The second arm 27 is provided with a pair of laterally spaced, downwardly projecting support lugs 29 at one end immediately adjacent the arcuate neck 28 and at the other or opposite end with a locking prong 30 projecting downwardly from one longitudinal edge of the arm 27 and a supporting post 31 similarly projecting downwardly from the opposite longitudinal edge. The second arm 27 is further provided with a central elongated opening 32 which is slightly wider than the reduced-width portion 26*a* of the first arm 26 such that the portion 26*a* can partly enter into the opening 32 when the locking means 25 is compressed by lifting the pull tab 20 as shown in FIGS. 2 and 3.

Figure 2:
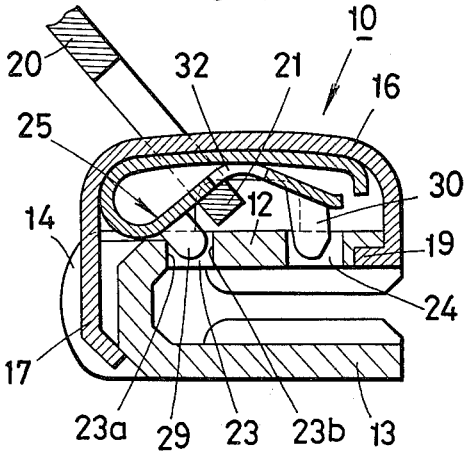
FIG. 2 is a view similar to FIG. 1 but showing the slider in unlocked position with its pull tab lifted and leaned in one direction.
Figure 3:
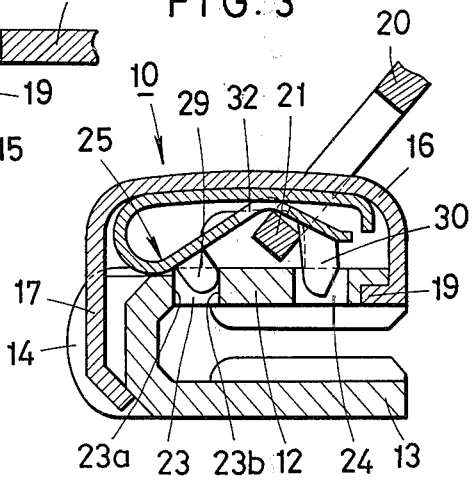
FIG. 3 is a view similar to FIG. 2 but showing the pull tab lifted and leaned in another direction.

It will be seen that the pair of support lugs 29 which have a rounded zip contour, extend substantially perpendicular to the plane of the flat stem portion 27*a* of the second arm 27, but are disposed at an angle slightly inclined relative to the plane of the upper shield 12 of the slider body 11 when the locking means 25 is accommodated within the yoke 16 as shown in FIGS. 2 and 3. The locking means 25 thus constructed is mounted in place with the lugs 29 inserted in the first respective apertures 23 and with the locking prong 30 and post 31 passed through the square aperture 20*a* of the pull tab 20 into the second respective apertures 24 in the upper shield 12.

Figure 1:
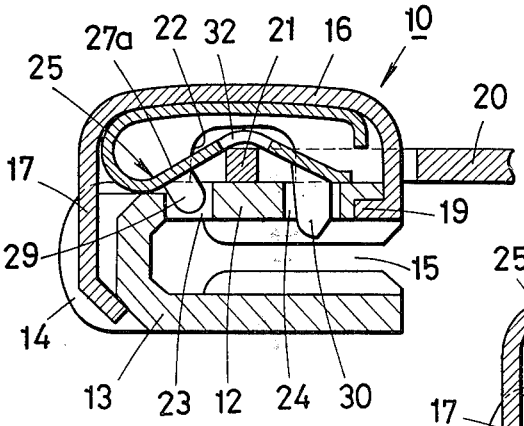
FIG. 1 is a longitudinal cross-sectional view of an automatically locking slider constructed in accordance with the invention, showing the same in locked position.

The operation of the automatically locking slider 10 according to the invention will now be described, reference being made to FIGS. 1 through 3 inclusive. FIG. 1 illustrates the slider 10 as in locked position wherein the pull tab 20 is flipped down flat against the upper shield 12 with the locking prong 30 urged by the tension in the resilient locking means 25 into the channel 15 to engage with the fastener stringer so that the slider 10 is locked into position on the fastener. As used herein, the term fastener stringer is intended to include the fastener elements carried ordinarily by a stringer tape, and thus while the prong 30 may actually contact such fastener elements, it should be regarded as engaging the stringer.

FIG. 2 illustrates the slider 10 as in unlocked position wherein the pull tab 20 is lifted against the tension of the locking means 25, pulling the locking prong 30 out of engagement with the fastener stringer, whereby the slider 10 is allowed to move along the fastener elements. In this posture of the pull tab 20, the slider 10 is pulled in a direction to close the fastener.

FIG. 3 illustrates the slider 10 similarly as in unlocked position but with the pull tab 20 disposed for manipulation to open the fastener in the well known manner.

Accordingly to an important aspect of the invention, the path of movement of the locking prong 30 into and out of the channel 15 through the corresponding aperture 24 of the upper shield 12 is held substantially invariable so as to accomplish the proper locking function without being affected by the pulling action of the pull tab 20 which would otherwise tend to shift the locking prong 30 out of position. This is achieved by the provision of the support lugs 29 integral with the second arm 27 which is disposed in the respective apertures 23 in such a manner that when the locking means 25 is pulled by the pull tab 20 in a direction to close the fastener as shown in FIG. 2, the support lugs 29 will abut against a front end wall 23*a* of each of the apertures 23 thereby restricting free longitudinal movement of the locking means 25 relative to the slider body 11. Conversely when the locking means 25 is pulled in a direction to open the fastener as shown in FIG. 3, the support lugs 29 will abut against the rear end wall 23*b* of the respective apertures 23 and serve to stop further longitudinal movement of the locking prong 30 regardless of the pull action of the tab 20.

While the invention has been disclosed as to one specific embodiment which it may assume in practice, it will be understood that the invention is not to be limited to the precise form and construction illustrated but various changes may be made therein without departing from the scope of the appended claims.

What is claimed is:

1. An automatically locking slider for a slide fastener which comprises an upper shield and a lower shield connected in spaced parallel relation to define therebetween a channel for the passage of two opposed slide fastener stringers carrying respective rows of interlocking elements, said upper shield having wall surfaces defining a cavity, and an aperture communicating with said channel; a yoke attached to said upper shield; a pull having a pivotal end received in said yoke for pivotal movement relative thereto; and releasable locking means disposed inside said yoke and having a resilient U-shaped structure bearing a locking prong and resiliently biasing same to extend through said aperture to engage at least one of said stringers and thereby lock the slider against movement relative thereto; said pull tab being manipulatable in each of two opposite directions to release the locking means and move the slider therealong, said locking means structure having a lug extending into said cavity for movement relative thereto upon flexing of said structure, said lug being arranged to move in abutment with one wall surface of said cavity when the pull tab is manipulated in one direction to release the locking means, and arranged to move in abutment with an opposite wall surface of said cavity when the pull tab is manipulated in the opposite direction to release the locking means thereby correspondingly limiting free longitudinal movement of the locking means.

2. An automatically locking slider as defined in claim 1 wherein said locking means is a resilient plate member centrally bent into a U-shaped structure consisting of two arms, and said support lug extends substantially parpendicularly from one of said arms adjacent the U-bent of said plate member.

* * * * *